US007600580B2

(12) United States Patent
Cravatte et al.

(10) Patent No.: US 7,600,580 B2
(45) Date of Patent: Oct. 13, 2009

(54) SEALED CORE SAMPLE BARREL

(75) Inventors: Philippe Cravatte, Aberdeen (GB); Nikola Vidman, Dundee (GB); Pascal Bartette, Dubai (AE)

(73) Assignee: Corpro Systems Limited, Aberdeenshire (GB)

( * ) Notice: Subject to any disclaimer, the term of this patent is extended or adjusted under 35 U.S.C. 154(b) by 59 days.

(21) Appl. No.: 11/409,129

(22) Filed: Apr. 21, 2006

(65) Prior Publication Data

US 2006/0237232 A1 Oct. 26, 2006

(30) Foreign Application Priority Data

Apr. 22, 2005 (GB) ..... 0508151.8

(51) Int. Cl.
*E21B 49/02* (2006.01)
*E21B 25/06* (2006.01)

(52) U.S. Cl. ..... 175/20; 175/58; 175/59; 175/226; 166/264; 73/864.51

(58) Field of Classification Search ..... 175/20, 175/58, 59, 226; 166/264; 73/864.51, 864.91, 73/863
See application file for complete search history.

(56) References Cited

U.S. PATENT DOCUMENTS 2,915,284 A 12/1959 Ortloff
3,092,192 A * 6/1963 Deely ..... 175/253
3,384,170 A * 5/1968 Poollen ..... 166/264
3,621,924 A 11/1971 Lebourg
3,872,935 A * 3/1975 Mielke ..... 175/58
4,230,192 A 10/1980 Pfannkuche et al.
4,312,414 A * 1/1982 Park ..... 175/59
4,690,216 A * 9/1987 Pritchard, Jr. ..... 166/264
5,307,884 A * 5/1994 Millgard ..... 175/20
2005/0183520 A1 * 8/2005 Learned ..... 73/864.51

FOREIGN PATENT DOCUMENTS

EP 1 411 206 4/2004
WO WO 95/21988 8/1995

* cited by examiner

*Primary Examiner*—Kenneth Thompson
(74) *Attorney, Agent, or Firm*—Drinker Biddle & Reath LLP

(57) ABSTRACT

The present invention relates to an apparatus and method for recovering a sample from a subterranean formation. The apparatus comprises a receptacle for receiving a sample and at least two seal assemblies disposed on an inner surface of the receptacle. The seal assemblies can be arranged to allow a portion of the sample therethrough during the sampling process and to retain fluids within the receptacle during recovery of the sample. The seal assemblies can comprise at least one seal. The at least one seal can be provided with at least one fluid pocket configured to change shape as the volume of fluid therein alters in response to a pressure differential. A plurality of pairs of seal assemblies can be spaced along the length of the inner surface of the receptacle.

18 Claims, 16 Drawing Sheets

SEALED CORE SAMPLE BARREL

BACKGROUND OF THE INVENTION

The present invention relates to apparatus and a method for obtaining a sample, such as a core sample, from a subterranean formation, such as those found in an oil or gas reservoir.

Extracting core samples from subterranean formations is an important aspect of the drilling process in the oil and gas industry. The samples provide geological and geophysical data, enabling a reservoir model to be established. Core samples are typically retrieved using coring equipment, which is transported to a laboratory where tests can be conducted on the core sample. However, difficulties arise as the coring equipment is recovered to the surface. As the coring equipment is retrieved from the subterranean formation, the ambient pressure of the environment reduces and gases within the core sample expand and expel fluids, such as oil, water or a mixture of these fluids, from the sample. If the expelled fluid cannot be recovered, this reduces the authenticity of the sample and the accuracy of the data that can be gathered from it.

BRIEF SUMMARY OF THE INVENTION

According to a first aspect of the present invention there is provided apparatus for recovering a sample from a subterranean formation comprising a receptacle for receiving a sample and at least two seal assemblies disposed on an inner surface of the receptacle.

Typically, the sample is a core sample.

Typically, each seal assembly is arranged to allow passage of a portion of the core sample therethrough during the sampling process, but can retain fluids within the receptacle.

According to a second aspect of the present invention there is provided a method for recovering a sample from a subterranean formation or the like, comprising the steps of:

(a) providing a receptacle having an inner surface and disposing at least two seal assemblies on the inner surface of the receptacle;

(b) running the receptacle into a subterranean formation;

(c) accommodating a sample from the subterranean formation in the receptacle such that at least a portion of the sample is disposed between the seal assemblies; and (d) recovering the receptacle with the sample disposed therein.

Preferably, the at least two seal assemblies are arranged to isolate portions of the receptacle, such that the seal assemblies create a fluid-tight seal when the sample is disposed in the receptacle in use. The seal assemblies can comprise any type of seal able to withstand the temperatures and pressures associated with the environment in which it is used. Elastomeric seals are useful in this regard. The seals can be lip-type seals. The seals can be manufactured from rubber or plastics material or the like, and some useful embodiments are formed from Viton™.

The seal assemblies can comprise at least one seal that can extend radially inwardly from the inner surface of the receptacle, so that when the sample is disposed therein, the seals seal off an annulus between the sample and the inner surface of the receptacle. One advantage of this arrangement is that during recovery of the sample, the seals form the main part of the receptacle in contact with the core sample, thereby minimising friction between the receptacle and the sample and reducing the risk of damage to the sample as it is being collected.

The apparatus can also comprise at least one fluid chamber arranged to receive fluids expelled from the sample. Typically, a change in hydrostatic pressure occurs in the sample during transit from the subterranean formation (with a high ambient hydrostatic pressure) to the surface (with a relatively lower atmospheric pressure) and this causes fluids to be expelled from the core sample during recovery. Each fluid chamber can be arranged to receive and retain the fluid expelled from the sample. Preferably, the at least one fluid chamber is provided between adjacent seal assemblies such that the fluid is retained within the chamber sealed between two seal assemblies. Each pair of seal assemblies can define an annular fluid chamber therebetween when the core sample is disposed within the receptacle. Each fluid chamber may be defined by the annular space between adjacent seal assemblies, the inner surface of the receptacle and the exterior of the core sample when disposed therein.

The receptacle can comprise an inner barrel, and an outer barrel spaced relative to and coaxial with the inner barrel, thereby creating a reservoir between the inner barrel and the outer barrel. Preferably, the seal assemblies are provided on the inner surface of the inner barrel. Preferably, the reservoir is in selective fluid communication with the throughbore of the inner barrel where the sample is retained. Preferably, the reservoir between the inner barrel and the outer barrel is also sealed at each end, in the region of the seal assemblies provided on the inner surface of the inner barrel. Thus, any fluid expelled from the core sample can be captured between adjacent seal assemblies in the fluid chamber and transferred to the reservoir by virtue of the fluid communication therebetween. In this way, fluid expelled from the core sample can be effectively retained between the seal assemblies in one or both of the fluid chamber and the reservoir.

The receptacle can be provided in at least two separable portions for ease of access to the sample after recovery. The at least two separable portions of the receptacle can be complementary to form a cylinder. The cylindrical embodiment of the receptacle has a cylindrical axis defined by the long axis extending through the bore of the cylinder. The at least two portions can be separable along a line extending between the two ends of the portions, typically substantially parallel to the cylindrical axis, so that the at least two portions can be separable laterally from one another. Typically the portions are in the form of half shells. Provision of at least the inner barrel of the receptacle in separable portions is advantageous since the core sample does not then have to be withdrawn axially from the receptacle for analysis, which generates friction and could result in the core sample being damaged. Rather, the core can be accessed and exposed by lifting one of the portions away from the core sample, without direct manipulation of the sample.

A plurality of pairs of seal assemblies can be spaced along the length of the inner surface of the receptacle. Each pair of seal assemblies can be provided with fluid chambers therebetween, such that fluids can be recovered from and associated with discrete segments of core sample from which they were expelled during transit. This enables the quantity of fluids, such as oil and water, to be measured from the sample and any variation in the quantity or composition of fluids contained within each segment can be determined over the length of the sample. The greater the number of seal assemblies and sealed fluid chambers over a certain length of sample, the greater the resolution of the collected data on the variation in composition of the fluids contained within the sample. Therefore, the number of sealed chambers, and the axial spacing between them can be varied to adjust the resolution required.

The seals can be provided with at least one fluid pocket, configured to change shape, as the volume of fluid therein alters in response to a pressure differential. The at least one fluid pocket can be filled with fluid at atmospheric pressure and arranged to at least partially collapse as the volume of fluid in the pocket decreases under the high pressures experienced in subterranean formations. The seals can be provided with at least one air pocket at atmospheric pressure. As the receptacle is transported to the subterranean formation of interest, an air pocket in the seals at least partially collapses under the higher subterranean pressures, thereby reducing the amount of friction between the seals and the core sample during entry of the sample into the receptacle.

The at least one fluid pocket can be in selective fluid communication with an ambient pressure to which the apparatus is exposed. An activation means can be provided, and optionally the activation means is operable to selectively alter the pressure differential across the at least one fluid pocket. Optionally, the activation means can be operable to selectively expose the at least one fluid pocket to the ambient pressure to which the apparatus is exposed i.e. the at least one fluid pocket is capable of fluid communication with an ambient pressure to which the apparatus is exposed on operation of the activation means.

At least one of the outer barrel and the inner barrel can be arranged in relation to the seal assemblies to move between a first configuration in which the fluid pocket is not exposed to an ambient pressure and a second configuration in which the fluid pocket is exposed to the ambient pressure, wherein the activation means is optionally operable to cause relative movement of the inner and outer barrel between the first and second configurations. Preferably, the seals are resilient. Before running the apparatus to the subterranean formation, the seals can be resiliently biased radially inwardly in the throughbore of the inner barrel with the fluid pocket of the seals optionally at or near atmospheric pressure. As the apparatus is moved towards the subterranean formation, the pressure can increase and the pressure differential across the seals can cause the fluid pocket to collapse thereby altering the configuration of the seals. Once the sample has been collected, the activation means can cause relative movement of the inner barrel and outer barrel to bring the fluid pocket into contact with the ambient pressure. At this point, no pressure differential exists across the fluid pocket. Therefore, the configuration of the seals can alter under its own resilience to occupy the original shape, biased radially inwardly to seal against the sample.

A releasable plug member engagable with the seal assemblies can be provided, such that when the plug member is engaged with the seal assemblies there is no fluid communication between the at least one fluid pocket and the ambient environment and wherein releasing the plug member allows fluid communication between the ambient environment and the fluid pocket. The activation means can be provided to selectively release the plug member. The plug member can comprise at least one hollow shear screw coupled to a band. The activation means can comprise a diverting member capable of diverting a fluid flow e.g. mud flow to act on and cause movement of the band to thereby shear the at least one shear screw.

Alternatively, as the receptacle is withdrawn from the formation to the surface, the environmental pressure decreases until the air pockets regain their original shape at atmospheric pressure. Thus the seal is improved between the seals and the core sample as the core barrel assembly is recovered from the subterranean formation and the environmental pressure decreases. In the case where the receptacle is cylindrical and the seals are annular, they can be provided with an annular air pocket.

BRIEF DESCRIPTION OF SEVERAL VIEWS OF THE DRAWINGS

Embodiments of the invention will now be described with reference to and as shown in the following drawings, in which.

DETAILED DESCRIPTION OF THE INVENTION

Figure 1:
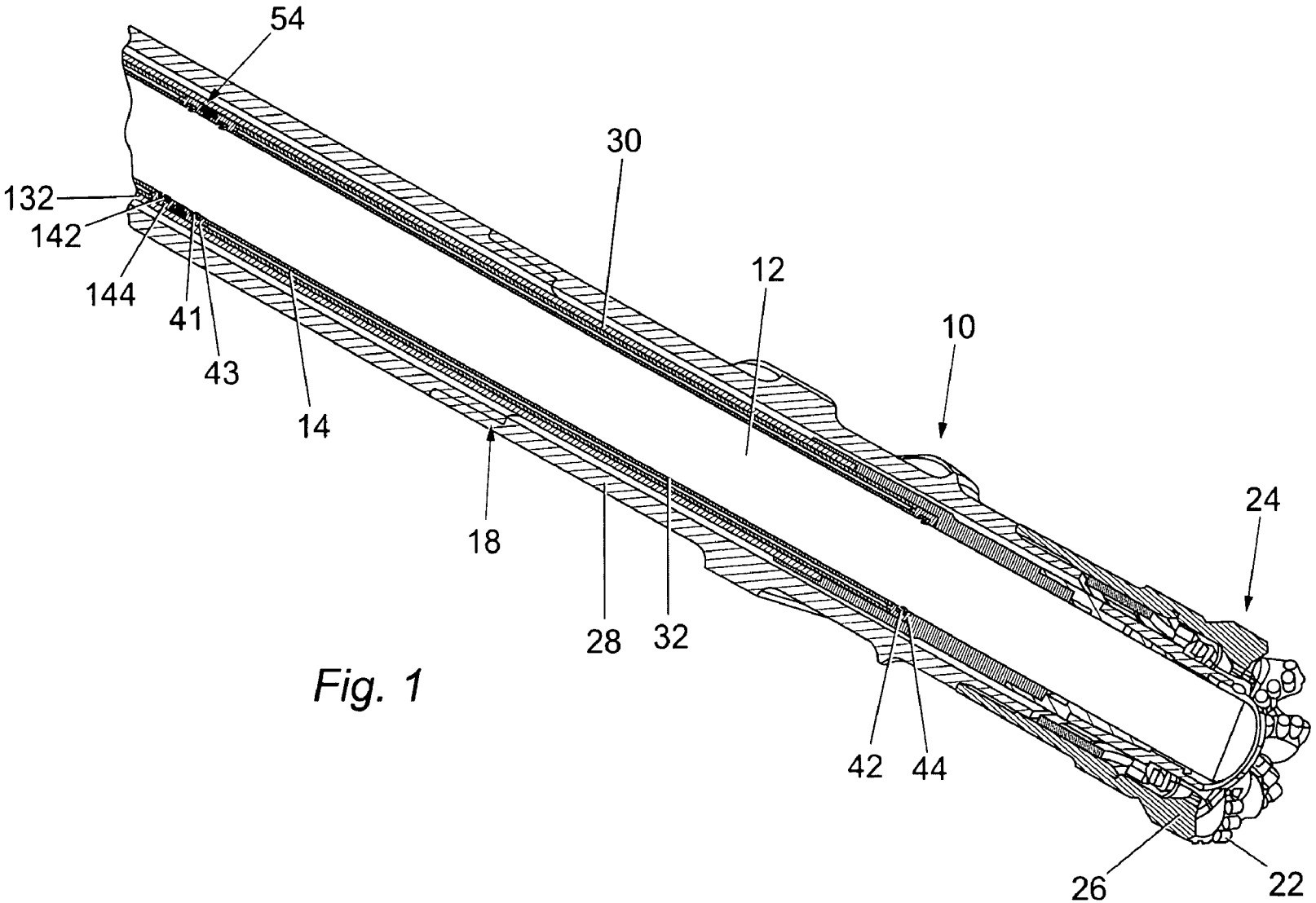
FIG. 1 is a sectional perspective view of a core barrel assembly having a core sample disposed therein.

FIG. 1 shows a core barrel assembly indicated generally at 10 and having a core sample 12 disposed therein. The core barrel assembly 10 comprises an inner assembly 14 and an outer assembly 18 sharing a common cylindrical axis 20. The outer assembly 18 houses the inner assembly 14.

The outer assembly 18 comprises a tubular outer casing 28 with a core head 26 comprising a plurality of cutters 22 provided at a lower end 24 of the outer casing 28. The cutters 22 are provided to engage a geological formation (not shown) to cut a core sample 12 which may then be recovered in the inner assembly 14. The outer casing 28 is typically made of steel.

The inner assembly 14 comprises a barrel 30, which houses a series of liner modules 32, 132. The barrel 30 is removably accommodated within the outer casing 28.

Figure 2:
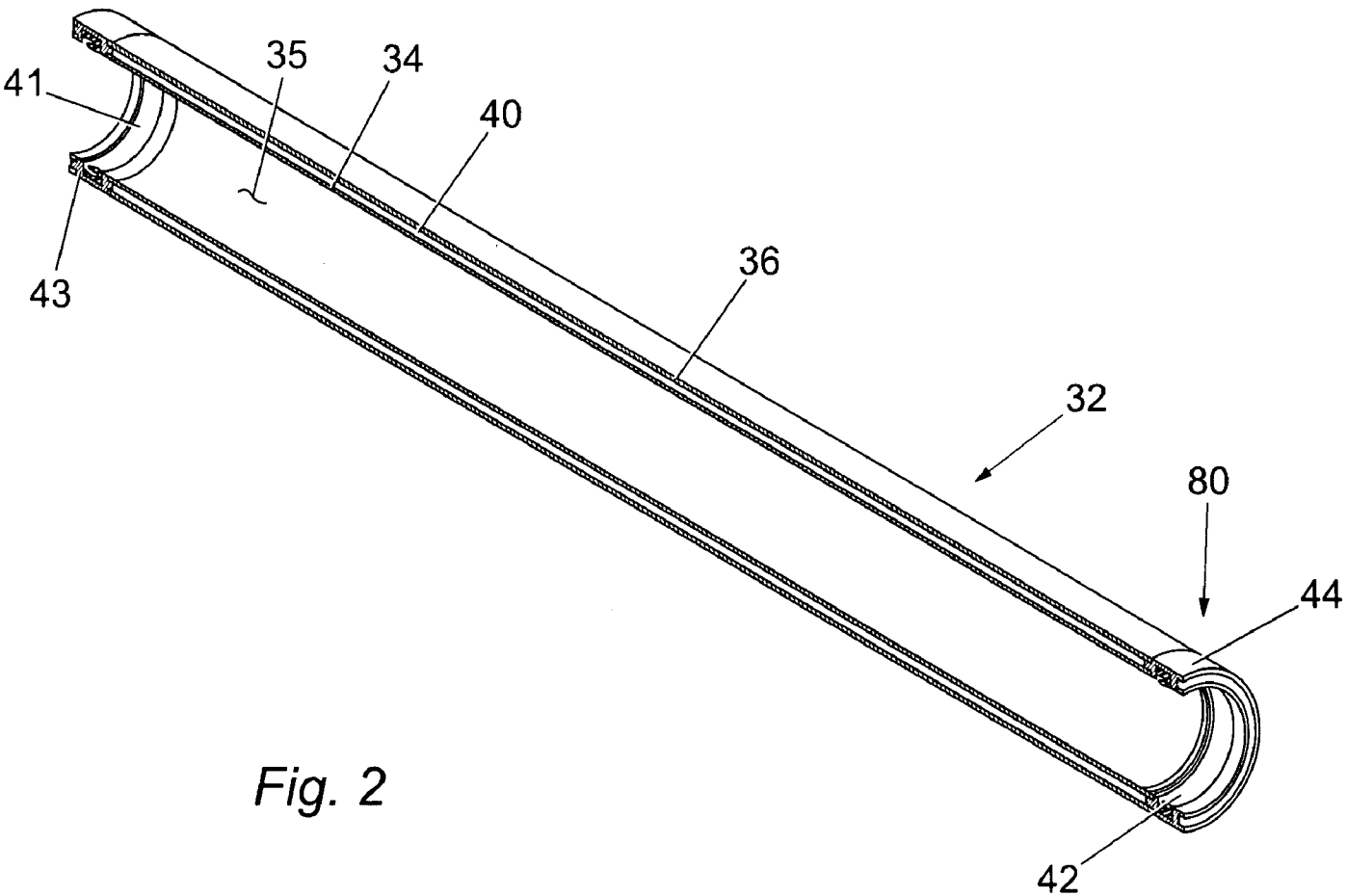
FIG. 2 is a perspective view of one half of a liner module of the core barrel assembly shown in FIG. 1.

Each liner module 32 is provided in two portions which engage along their long edge parallel to the cylindrical axis 20 of the core barrel assembly 10. One portion forming half of the liner module 32 is shown in greater detail in FIG. 2. Each portion of liner module 32 comprises an inner liner 34, an outer liner 36 and a seal assembly 80 at each end.

The inner liner 34 has a throughbore 35 which can accommodate the core sample 12. The outer liner 36 is coaxial with and spaced around the inner liner 34 to create an annular fluid reservoir 40 therebetween. The inner liner 34 and outer liner 36 are typically manufactured from aluminium.

The inner liner 34 and the outer liner 36 are connected at each end by the seal assembly 80. Each seal assembly 80 includes a coupling ring 43, 44 and a lip seal 41, 42. The lip seals 41, 42 are typically manufactured from Viton™, although it will be appreciated by a person skilled in the art that any elastomeric seal suitable for the application can be used.

Figure 3:
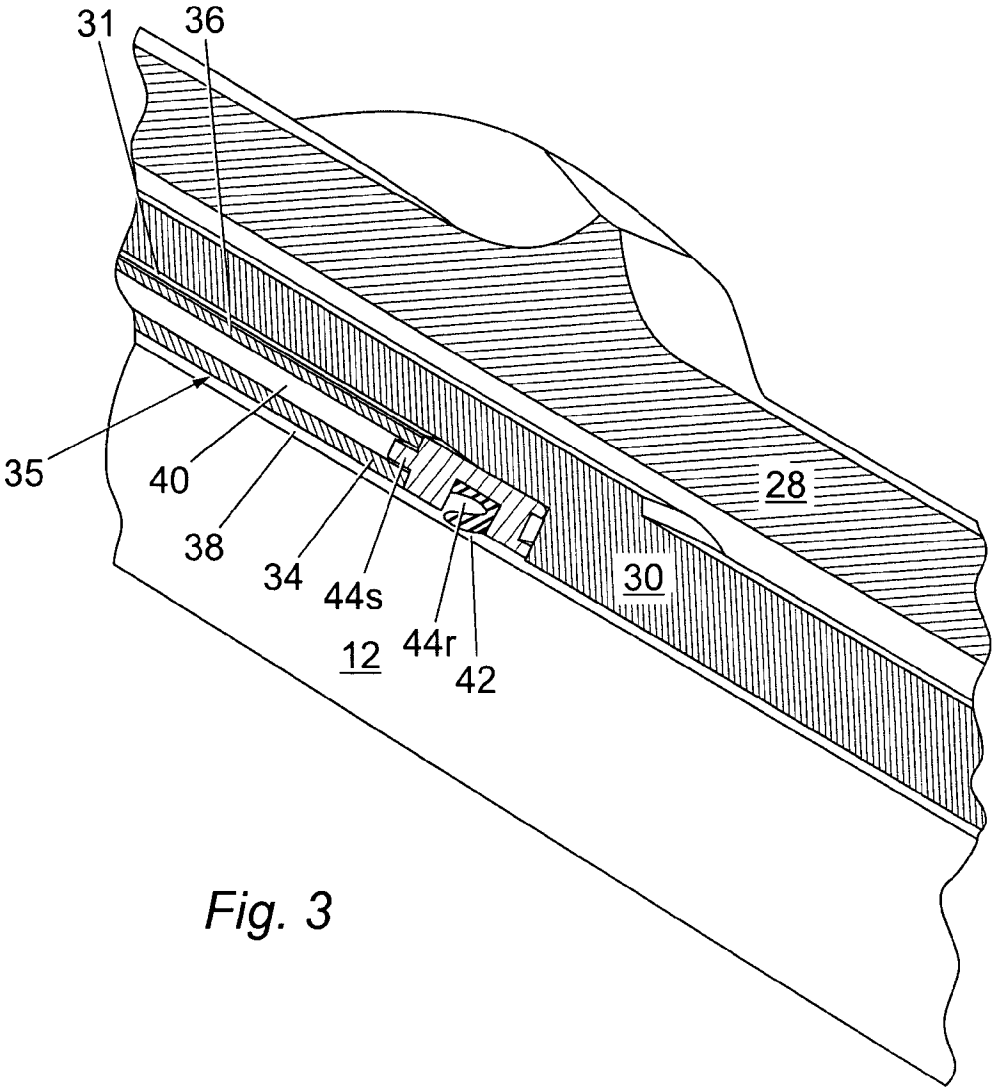
FIG. 3 is a detailed sectional perspective view of a portion of the core barrel assembly of FIG. 1.
Figure 4:
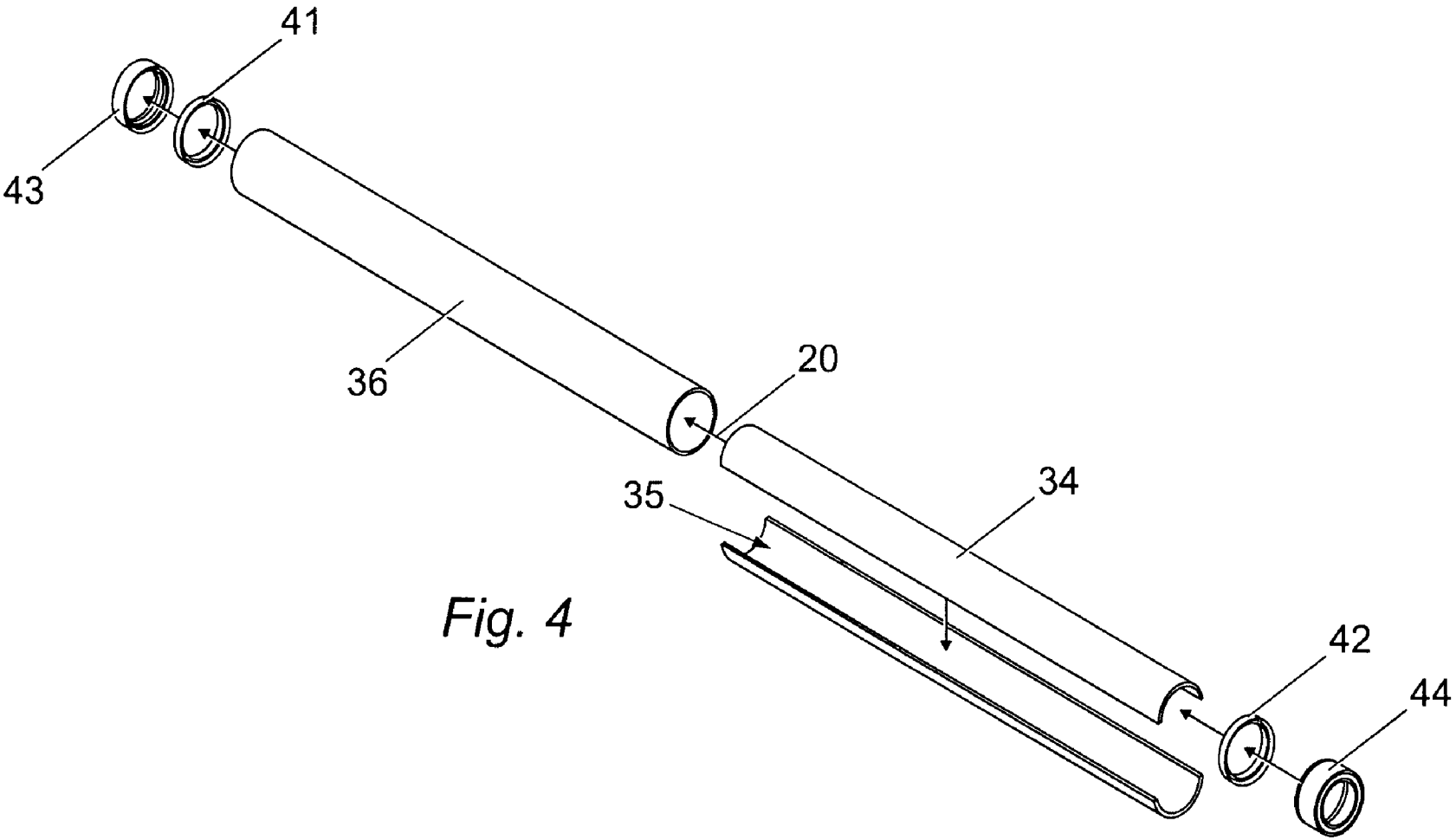
FIG. 4 is an exploded view of the liner module shown in FIG. 2.

As shown in FIG. 1, the coupling ring 44 is provided at the lower end of the liner module 32 and the coupling ring 43 is provided at the upper end. Each coupling ring 43, 44 has an annular step 44S shown in detail in FIG. 3. The annular step 44S radially spaces the inner liner 34 from the outer liner 36, and its radial dimensions define the radial width of the annular reservoir 40. Each coupling ring 43, 44 is also provided with a recessed portion 44R on its inner surface, which houses the lip seal 41, 42. The lower coupling ring 44 carries the lower lip seal 42 and the upper coupling ring 43 carries the upper lip seal 41. The lip seals 41, 42 are both upwardly facing, so as to present very little frictional resistance on entry of the core sample into the bore 35. In the present embodiment, the distance between the lip seals 41, 42 is one metre, but this distance can be altered to modify the resolution of the apparatus.

Each liner module 32 is attached to an adjacent liner module 132 by means of a coupling band 54. Several liner modules 32, 132 etc. are attached in series and housed within the barrel 30 to form the inner assembly 14.

Figure 5:
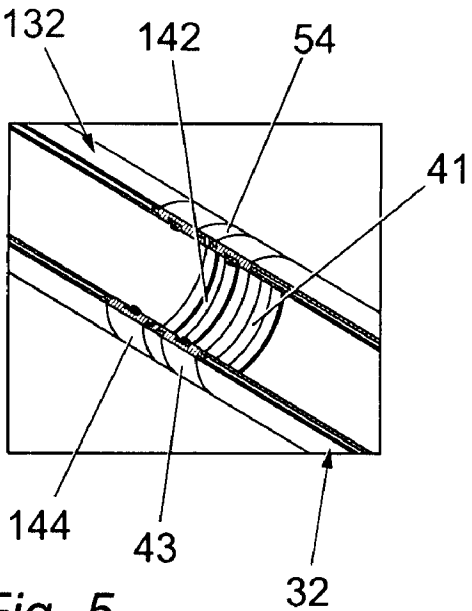
FIG. 5 is a perspective view of one half of a coupling.

The coupling band 54 is shown in more detail in FIG. 5. The coupling band 54 has a generally T-shaped half-shell construction that has grooves to engage and retain the lower coupling ring 144 from one liner module 132 and the upper coupling ring 43 from the adjacent liner module 32. The coupling band 54 forms a rigid connection between the two coupling rings 43, 144.

The upper coupling ring 43 is provided with two ports (not shown) which are used to recover liquid sealed in the annular reservoir 40. These ports remain closed during insertion and recovery of the core barrel assembly 10 and are only opened in the laboratory to allow fluids to be recovered from the annular reservoir 40.

The lower coupling ring 44, 144 is provided with four ports 70. Two of these ports are plugged and remain closed during use of the core barrel assembly 10, until the fluids contained within each liner module 32, 132 need to be accessed in the laboratory. The remaining two ports 70 are provided to selectively allow the reservoir 40 to be in fluid communication with an annulus between outer liner 36 and the barrel 30 when the core sample 12 is accommodated in the inner assembly 14. These ports 70 are opened and closed when subject to pressure of a predetermined value.

Figure 7:
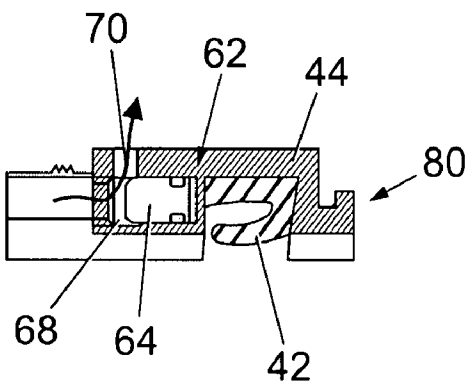
FIG. 7 is a sectional view of an open port in the coupling ring of FIG. 6.
Figure 6:
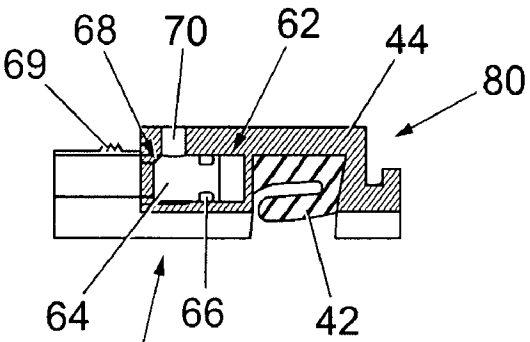
FIG. 6 is a sectional view of a closed port in a coupling ring.

FIGS. 6 and 7 show the coupling ring 44, housing a valve 60 provided adjacent the port 70. The coupling ring 44 is provided with threads 69 which engage corresponding threads (not shown) on the outer liner 36 to connect and seal the coupling ring 44 and the outer liner 36.

Each valve 60 comprises a chamber 62 and a piston 64 sealed in the chamber 62 by an O-ring 66. The chamber 62 contains the piston 64 and the remainder of the chamber 62 is filled with fluid such as air. When the core barrel assembly 10 is at atmospheric pressure the volume of fluid in the chamber 62 is high, causing the piston 64 to abut a valve seat 68 and close the port 70.

Before use, the inner assembly 14, comprising the required number of liner modules 32, 132 etc. joined by coupling bands 54, is inserted into the outer assembly 18 to form the core barrel assembly 10. The core barrel assembly 10 is lowered on a drill string to a location from which the core sample 12 is to be obtained. The pressure of the environment gradually increases as the core barrel assembly 10 is transported to the subterranean formation. The increased pressure causes the air in the chamber 62 of valve 60 to compress. At a predetermined level, for example, in the present embodiment when the hydrostatic pressure is greater than 2 bars, the air in the chamber 62 will be compressed to such an extent that the piston 64 moves away from the valve seat 68 to open a fluid channel between each port 70 and the fluid reservoir 40.

In order to obtain a core sample the cutters 22 are rotated and the core barrel assembly 10 is drilled into the geological formation. The core sample is collected in the inner assembly 14 as the cutters 22 drill into the formation. Frictional forces on the core sample 12 are reduced on entry into the inner assembly 14 by spacing the inner surface 31 of the inner assembly 14 away from the sample by means of the annular fluid chamber, and ensuring that the main areas of contact between the core sample 12 and the inner assembly 14 are the seals 41, 42. Thus, the contact surface area between the inner assembly 14 and the core sample 12 is minimised to restrict the friction therebetween in order to reduce the risk of damaging the core sample 12 as it is being collected. Once the sample 12 is disposed within the throughbore 35 of the inner liner 34, a spring catcher at the leading edge of the assembly 10 just above the cutters 22 is closed to cut the end of the sample and secure it within the core barrel assembly 10.

As the core barrel assembly 10 is pulled out of the well by the drill string or the like, the ambient hydrostatic pressure decreases and fluid held within the core sample 12 expands and can be ejected from the sample 12. This fluid is retained in the annular fluid chamber 38, between the lip seals 41, 42, the inner liner 34 and the core sample 12. Some of the expelled fluid held in the annular fluid chamber 38 leaks into the reservoir 40, where it is likewise retained for later recovery at surface. The expelled fluids can leak from the annular fluid chamber 38 to the reservoir 40 through the joint between the half shells of the inner liner 34 or through apertures (not shown) extending through the sidewall of the inner liner 34 and specially provided for the purpose. The lip seals 41, 42 prevent leakage from the area between the seals 41,42 into adjacent modules 132.

In the present embodiment, oil is the fluid to be quantified and analysed and which is expelled from the core sample 12. The expelled oil is immiscible with and less dense than the drilling fluids, mud and brine which were originally present within the inner assembly 14 as a result of the drilling process. Thus, on entry into the reservoir 40, the expelled oil is collected towards the upper end of the reservoir 40, thereby forcing some of the drilling fluid, brine and mud out of the liner modules 32, 132 through ports 70 and into the annulus 38.

Alternatively, in an embodiment where the relative proportion of water is the expelled fluid of interest, ports 70 and accompanying valves 60 may instead be provided in the upper coupling ring 43 since the water has a greater density than the drilling fluids and brine originally present. This will ensure that the fluids expelled from the core sample 12 are retained within the modules 32, 132 at the lower end of the modules while the drilling fluids originally present are forced out of the ports 70 located in the upper coupling ring 43.

The reduction in hydrostatic pressure as the core barrel assembly 10 is recovered to the surface causes the fluid in chamber 62 to expand until at a pressure approximately less than 2 bars, the piston 64 abuts the valve seat 68 so that the valve 60 closes off port 70 to prevent further fluid loss from the modules 32, 132.

Once the core barrel assembly 10 has been recovered from the wellbore, the inner assembly 14 can be removed from the outer assembly 28 on the rig side. The inner assembly 14 with the core sample 12 contained therein can be cut into lengths of liner modules 32, 132. A cut can be made in each coupling band 54 to split the first and second coupling rings 43, 144 and separate each liner module 32, 132. Since each liner module 32, 132 is provided with a lip seal 41, 42, 142 at each end, the fluid ejected from the core sample 12 between the seals 41, 42, 142 remains contained within each respective module 32, 132.

The liner modules 32 enclosing sections of core sample 12 are then transported to a laboratory for geological and geophysical data to be recovered therefrom. The ports (not shown) in the upper and lower coupling rings 43, 44 can be unplugged to allow solvent to be injected into each module 32 to flush out fluids in the fluid chamber 38 and the reservoir 40. This process recovers fluids originally contained within pores in the core sample 12 and forced out due to the changes in hydrostatic pressure during recovery to surface. The quantities of the fluids present, such as oil and water can be measured. If required, the composition of these fluids can then be determined using standard laboratory techniques. When fluid quantity and composition data has been gathered from several modules, the information can be collated to form an indication of the variation of fluids present, as well as their composition, across the entire sample 12.

One half of each liner module 32 can be lifted away to provide access and expose the core sample 12. The arrangement of the liner modules 32, 132 into two halves allows easy access to the core and means that it is not necessary to draw the core sample 12 axially out of the inner barrel 30 which may have potentially harmful consequences as it could damage the core sample 12.

The use of seals 41, 42 is advantageous as it splits the core sample 12 into segments between the seals 41, 42 allowing data to be recovered from a series of consecutive known depths and allowing accurate determination of the oil and water content and type originally contained within each segment of core sample 12 as this is retained within the fluid chamber 38 or the reservoir 40 between the seals 41, 42. Thus, the core sample can be recovered with an accurate indication of fluids present within the sample 12 as a whole.

The distance between the seals 41, 42 determines the resolution of the data regarding fluids from the core sample 12. Accordingly, the resolution can be improved by decreasing the distance between the seals 41, 42. More than one pair of seals can be provided per module 32 in order to increase the resolution.

The number of modules 32 which are positioned end to end within the inner assembly 14 is dependent on the length of each module 32 and the resolution required for each application. The modules 32 may be designed to be used within standard core barrel lengths. Alternatively, the application may dictate that a certain length of core sample 12 is required, along with a specific resolution and therefore the required number of modules 32 may be provided.

Although lip seals 41, 42, 142 are shown in the embodiment of FIGS. 1-4, it will be appreciated by a person skilled in the art that any suitable seal may be used. For example, core barrel assemblies 10 to be used downhole may have to withstand high pressures and therefore high temperature seals may be required. O-ring seals may be used. However, O-ring seals generally require a greater tolerance. A lip seal will be generally appreciated to provide a better fluid tight seal for this application than a standard O-ring seal. This may be important if the core sample 12 recovered by the cutters 22 has a variable diameter in places.

Figure 9:
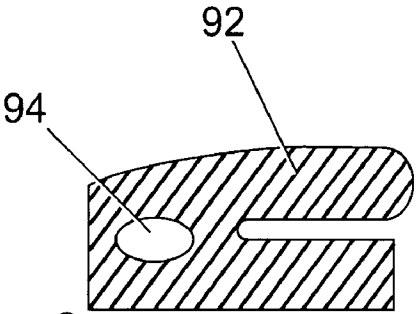
FIG. 9 is a sectional view of the lip seal of FIG. 8 with the air pocket partially collapsed.
Figure 8:
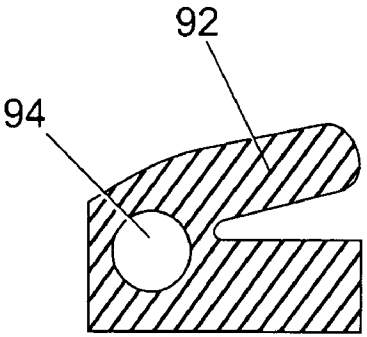
FIG. 8 is a sectional view of a lip seal including an air pocket.

FIGS. 8 and 9 show a modified lip seal 92. Lip seal 92 is annular and is provided with an annular air pocket 94, although a number of discrete non-annular air pockets could instead be provided. FIG. 8 shows the air pocket 94 at surface atmospheric pressure at which the air pocket 94 is substantially circular in cross-section. As the core barrel assembly 10 is transported downhole, the ambient hydrostatic pressure increases with the depth of the assembly 10, and as a result of this increasing hydrostatic pressure, the air pocket 94 at least partially collapses as shown in the sectional view of FIG. 9. When the assembly arrives at the required depth to cut the sample 12, the collapsing air pocket 94 changes the resting configuration of the seal to move the seal 92 radially inwards away from the sample 12 as it is being received within the assembly 10. This reduces the frictional forces acting on the sample 12 during the sampling procedure, and reduces the risk that the sample will jam in the inner assembly 14 while it is being collected, thereby resulting in a more representative sample being collected.

After collection of the sample 12 and closure of the spring catcher, the upward movement of the assembly 10 through the well increases the ambient pressure acting on the assembly, and therefore expands the pocket 94, gradually returning the pocket to its original shape and causing the seal 92 to move radially inwards once again to bear against the outer surface of the sample 12 and thereby improve the seal as the core barrel assembly 10 is removed from the wellbore.

An alternative seal arrangement and method of sealing around a core sample is described with reference to FIGS. 10-14.

Figure 10:
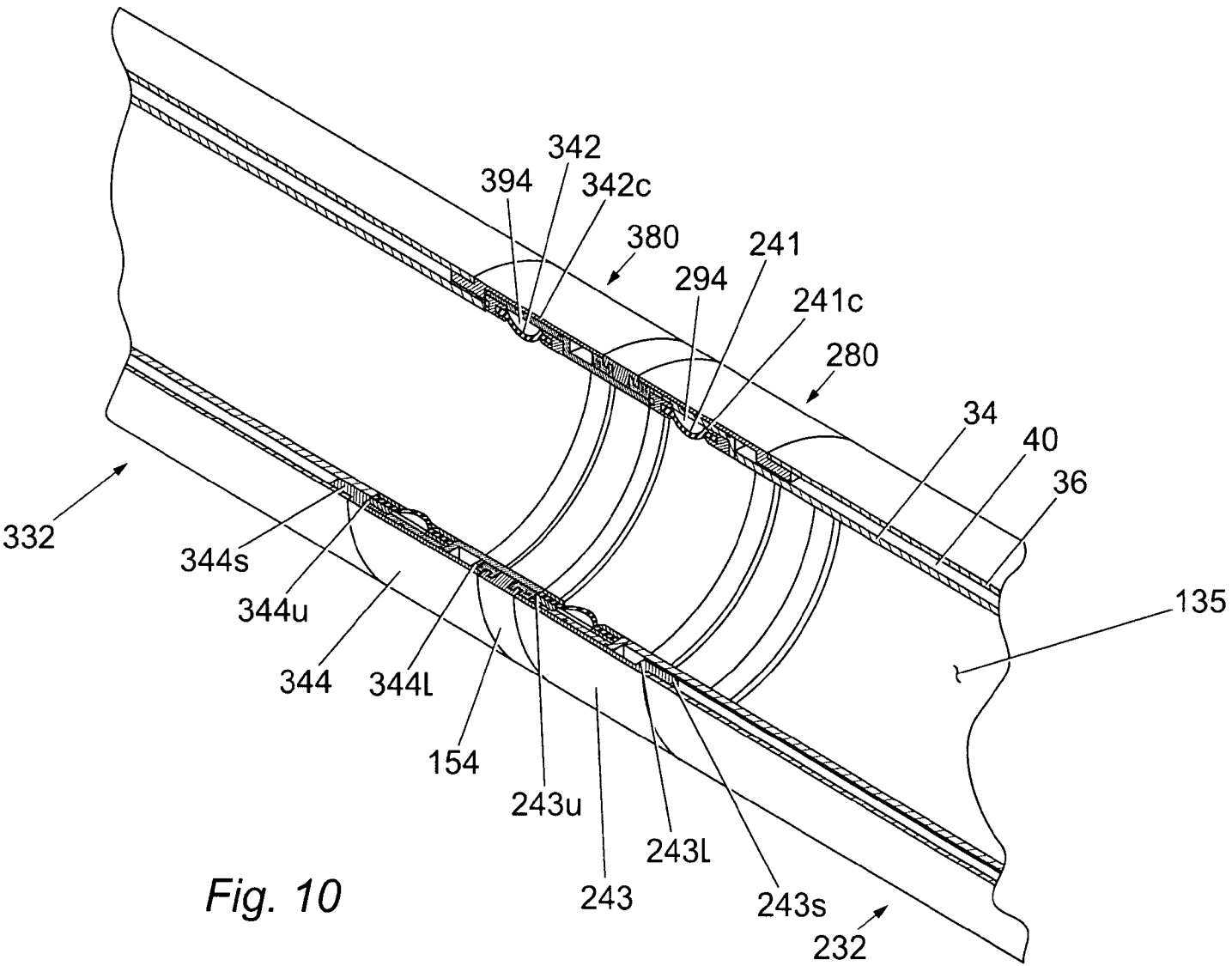
FIG. 10 is a perspective view of one half of two liner modules provided with an alternative seal assembly and prior to transport into a subterranean formation.

FIG. 10 shows one half of two coupled liner modules 232, 332. Each liner module 232, 332 is shown with the outer liner 36 surrounding and coaxial with the inner liner 34 as described for the previous embodiment. The inner liner 34 and the outer liner 36 are connected at each end by a seal assembly 280, 380 respectively. Each seal assembly 280, 380 includes a coupling ring 243, 344.

A coupling band 154 joins adjacent coupling rings 243, 344 of the module 232, 332. The coupling band 154 has a generally T-shaped half shelf construction and grooves to engage and retain the lower coupling ring 344 from the liner module 332 and the upper coupling ring 243 from the adjacent liner module 232. The coupling band 154 thereby forms a rigid connection between the two coupling rings 243, 344.

The coupling ring 243 is provided towards an upper end of the liner module 232 and the coupling ring 344 is provided towards the lower end of the liner module 332. Each coupling ring 243, 344 has an annular step 243S, 344S at one end thereof to space the inner liner 34 relative to the outer liner 36 thereby defining the fluid reservoir 40. The coupling rings 243, 344 also have an upper annular shoulder 243U, 344U and a lower annular shoulder 243L, 344L defining a centrally disposed recess 243R, 344R in which a respective annular seal cup 241C, 342C, each carrying a seal 241, 342 is accommodated. The seal cups 241C, 342C are attached to the inner liner 34. Each annular seal 241, 342 is resilient to project radially inwardly into a throughbore 135. The annular seals 241, 342 each have an annular air pocket 294, 394. Each seal cup 241C, 342C carrying the seals 241, 342 and coupling ring 243, 344 are capable of relative movement that is limited by the upper shoulder 243U, 344U and the lower shoulder 243L, 344L of each coupling ring 243, 344.

One or more radially disposed apertures (not shown) extending through a sidewall of the coupling ring 243, 344 are provided towards the lower shoulder 243U, 344U. The apertures are provided to ensure that the recesses 243R, 344R are in fluid communication with the exterior of the coupling ring 243, 344. The seal cups 241C, 342C carrying the seals 241, 342 are also provided with one or more holes (not shown) extending through the side wall of the seal cup 241C, 342C enabling the fluid pockets 294, 394 to be in fluid communication with the recesses 243R, 344R. However, annular O-ring seals 85 are positioned on either side of the hole(s) extending through the sidewall of the seal cup 241C, 342C. The O-ring seals 85 ensure that the hole in the seal cup 241C, 342C is only in fluid communication with the aperture in the coupling ring 243, 344 when the seal cup 241C, 342C is moved into a position where the O-ring seals 85 are also positioned either side of the aperture(s) in the coupling rings 243, 344.

Figure 11:
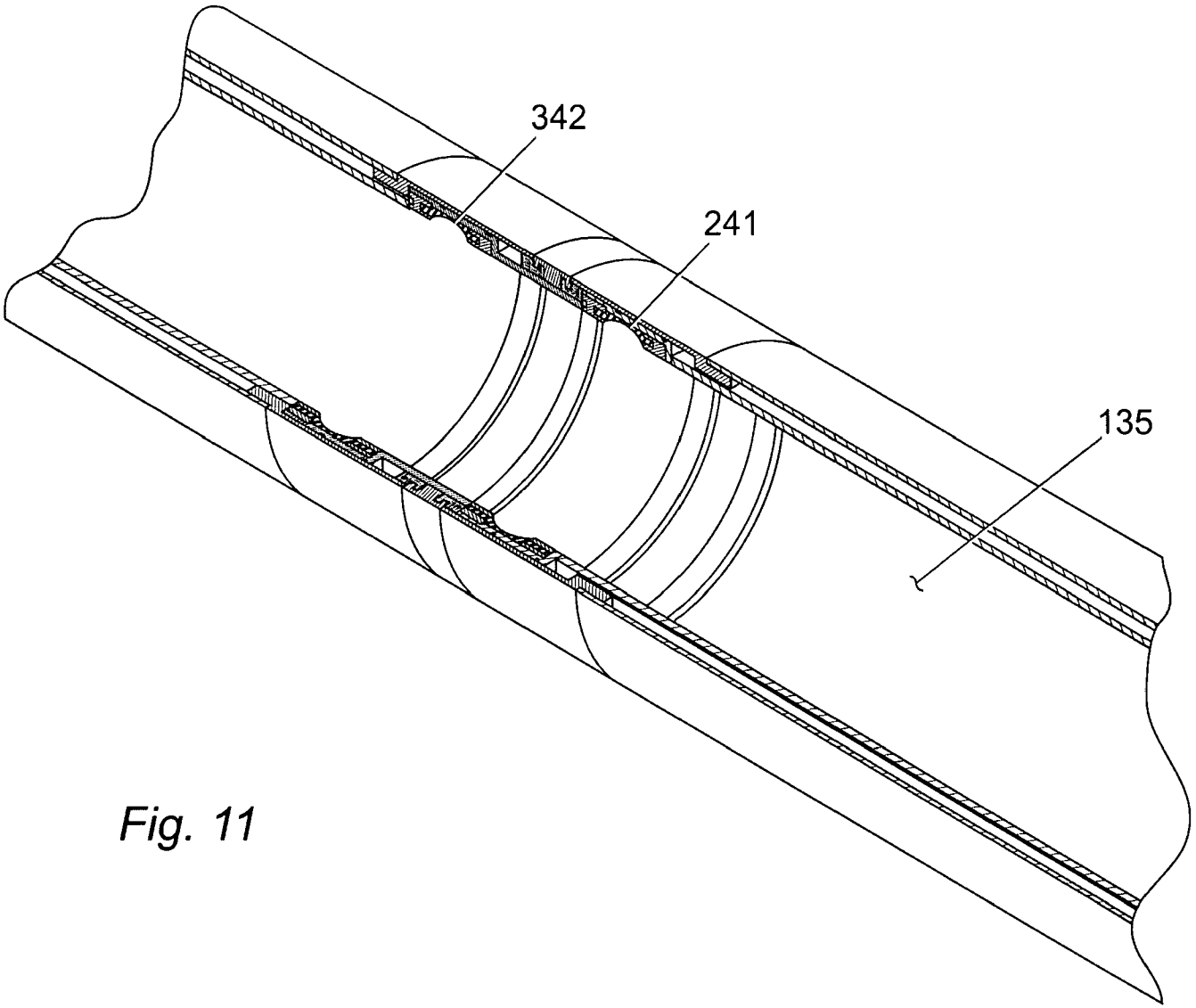
FIG. 11 is a perspective view of the liner modules of FIG. 10, with the seals represented in the downhole configuration.

Before use, several liner modules 232, 332, etc. are attached in series and housed within the barrel 30 to form the inner assembly 14 of the core barrel assembly 10 as described for the previous embodiment. The air in the fluid pockets 294, 394 of the seals 241, 342 is at atmospheric pressure and the seals 241, 342 are resilient and project radially inwardly into the throughbore 135 of each liner module 294, 394. Therefore, prior to insertion into the subterranean formation of interest, the seals protrude radially inwardly into the throughbore 135 of each liner module 232, 332 as shown in FIG. 10. The seal cups 241C, 342C housing the seals 241, 342 are shown in a first configuration in which they are positioned adjacent the upper shoulders 243U, 344U and the holes in the cups 241C, 342C are not in fluid communication with the apertures through the side wall of the coupling ring 243, 344. Therefore, as the core barrel assembly 10 is run into the downhole formation of interest, the ambient pressure increases and the pressure differential between the ambient environment and the air pockets 294, 394 causes the air pockets 294, 394 to collapse as shown in FIG. 11.

Figure 12:
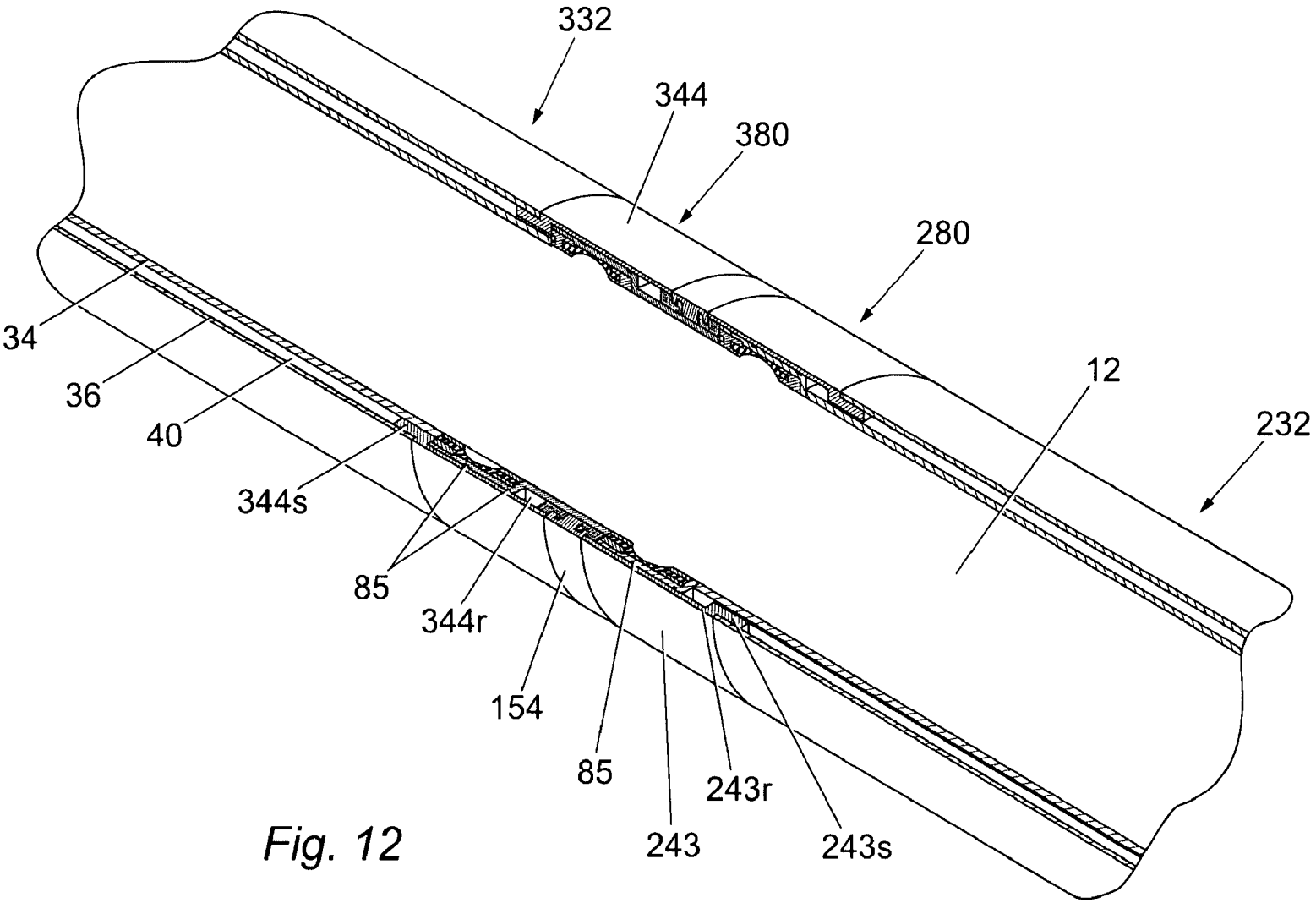
FIG. 12 is a perspective view of the liner modules of FIG. 11 with a sample disposed therein.
Figure 13:
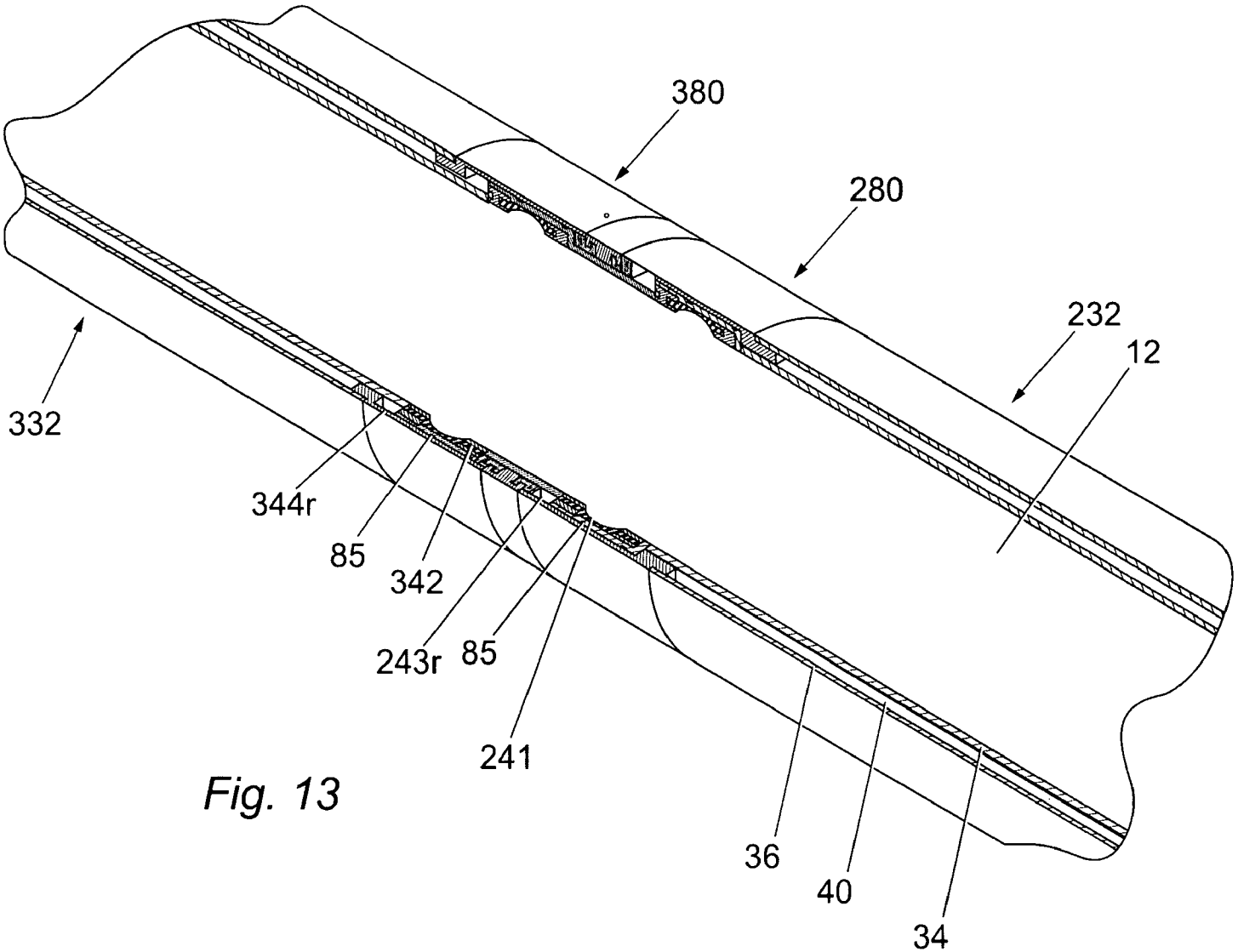
FIG. 13 is a perspective view of the liner modules of FIG. 12 showing relative movement of an inner and outer liner.
Figure 14:
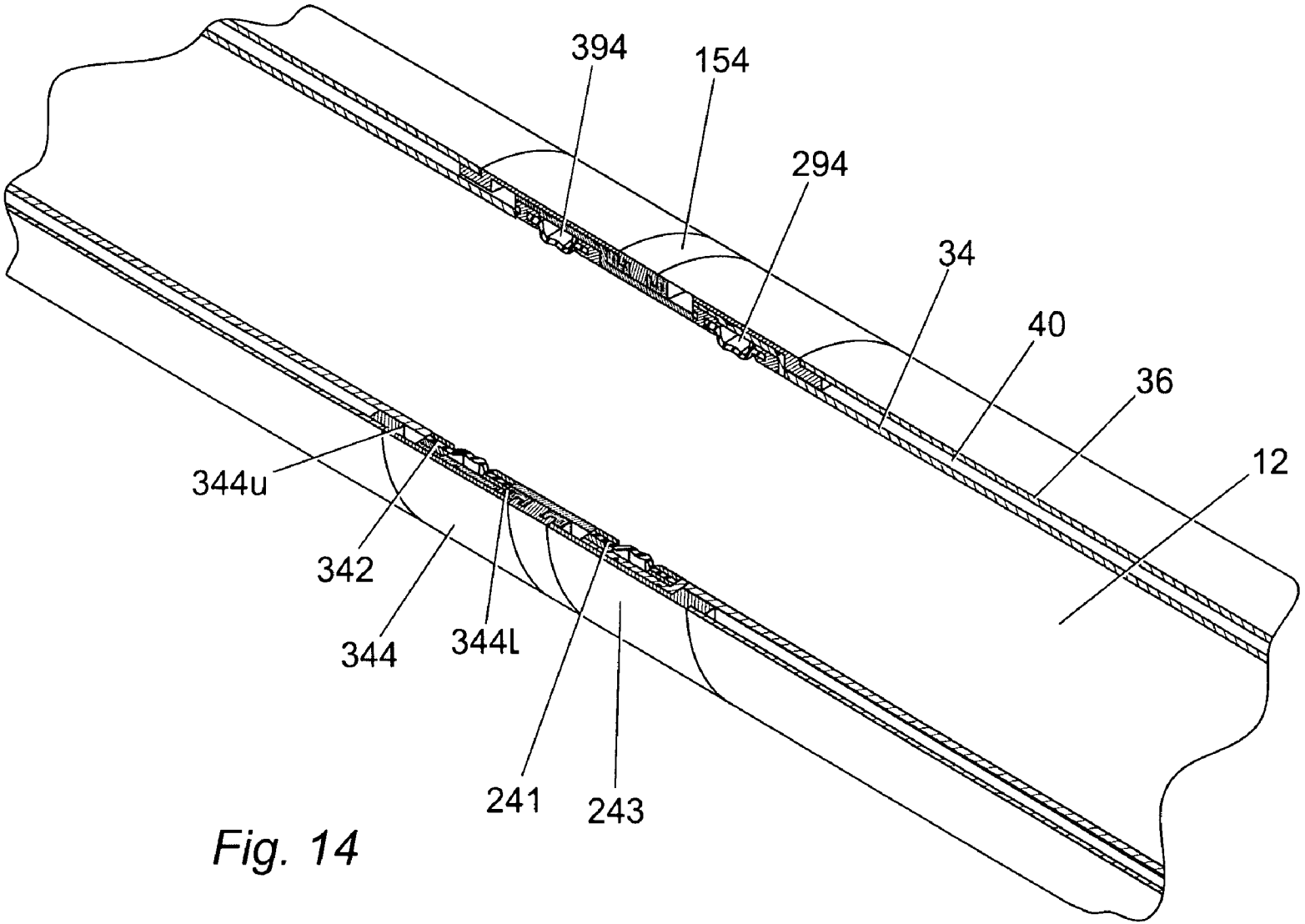
FIG. 14 is a perspective view of the liner modules of FIG. 13, with the seals in communication with an ambient pressure.

A core sample 12 is obtained in a similar manner as previously described and the sample 12 is collected within the throughbore 135 of the core barrel assembly 10 as illustrated FIG. 12. At this stage, it is desirable to ensure that each portion of the core sample 12 between the seal assemblies 280, 380 of each liner module 232, 332 is isolated from the portion of core sample 12 in an adjacent part of the core barrel assembly 10 to preserve an accurate record of the core sample 12 and fluids contained therein at a particular depth. Accordingly, the outer liner 36 is pulled upwardly to move the outer liner 36, the coupling rings 344, 243 and the coupling band 154 in relation to the seal cups 241C, 342C and the inner liner 34. In this way, the recesses 243R, 344R are moved into a second configuration in relation to the seals 241, 342 such that the seal cups 241C, 342C abut the lower shoulder 243L, 344L as shown in FIG. 13. This action causes the aperture extending through the side wall of the coupling rings 243, 344 to move between the O-ring seals 85 and therefore enable fluid communication between the hole extending through the sidewall of the seal cups 241C, 342C and the aperture in the coupling rings 243, 344. As a result, in this second configuration, the fluid pockets 294, 394 are brought into direct communication with the ambient pressure of the subterranean formation. Due to the equalising of pressures between the interior of the fluid pockets 294, 394 and the subterranean formation, as well as the resilience of the seals 241, 342, the seals 241, 342 return to their original shape and extend radially inwardly, biased against the core sample. In this way, portions of the core sample 12 are isolated within each module 232, 332, as shown in FIG. 14. The core barrel assembly 10 can then be retrieved from the subterranean formation with the seals 241, 342 biased against the sample 12 by their own resilience providing an effective sealing force against the core sample 12. Collection of fluid in the reservoir 40 is enabled in a similar manner as previously discussed and the core sample 12 can be stored, transported and retrieved as described for the previous embodiment.

Figure 15:
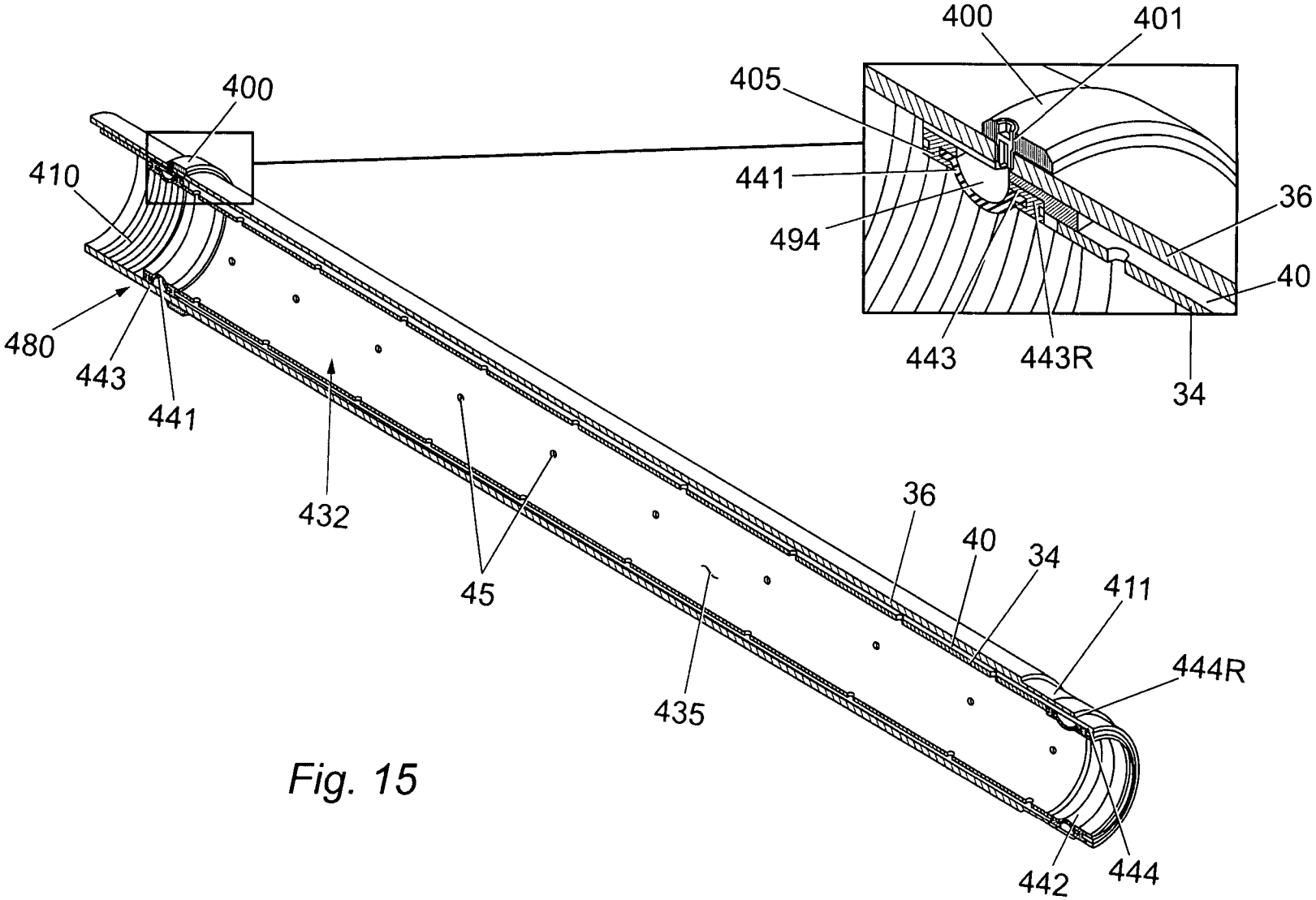
FIG. 15 is a perspective view of one half of a liner module provided with an alternative seal assembly.

Another alternative seal arrangement is shown in and described with reference to FIGS. 15 to 20. A liner module 432 comprising the inner liner 34, the outer liner 36 connected at each end by a seal assembly 480 is shown in FIG. 15. The inner liner 34 has a throughbore 435 which can accommodate the core sample 12. The inner liner 34 is punctured with a plurality of openings 43 such that the reservoir 40 is in fluid communication with the throughbore 435.

A lower ring 444 is provided at the lower end of the liner module 432 and an upper ring 443 is provided at the upper end. Each ring 443, 444 is provided with a recessed portion 443R, 444R on its inner surface. Each recessed portion 443R, 444R houses a seal 441, 442. The lower ring 444 carries the lower seal 442 and the upper ring 443 carries the upper seal 441. Each seal 441, 442 is resiliently biased radially inwardly into the throughbore 435 of the liner module 432. The seals 441, 442 have an annular air pocket 494 at atmospheric pressure. An upper end of the liner module 432 is provided with threads 410 on a box connection and a lower end of the liner module has threads 411 on a pin connection. The threads 410, 411 are provided for engaging the liner module 432 with corresponding threads (not shown) of an adjacent liner module or another part of the inner assembly 14.

As shown in the detailed view of FIG. 15, the upper ring 443 has an aperture 405 extending through the sidewall thereof. The aperture 405 is sealed using a hollow shear screw 401. An outer band 400 surrounding the outer liner 36 is held in position by the shear screw 401.

Figure 16:
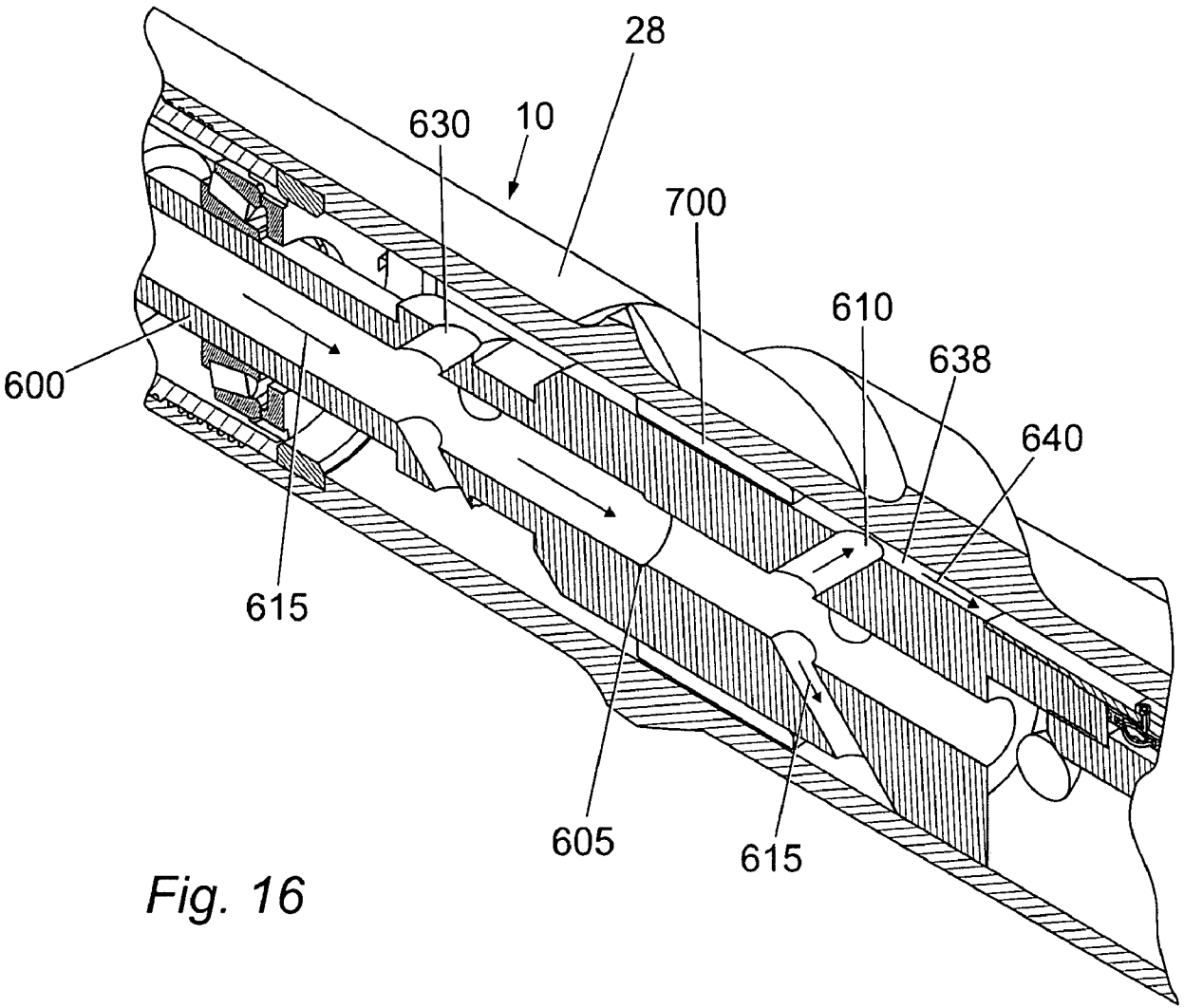
FIG. 16 is a perspective view of one half of a core barrel assembly.
Figure 17:
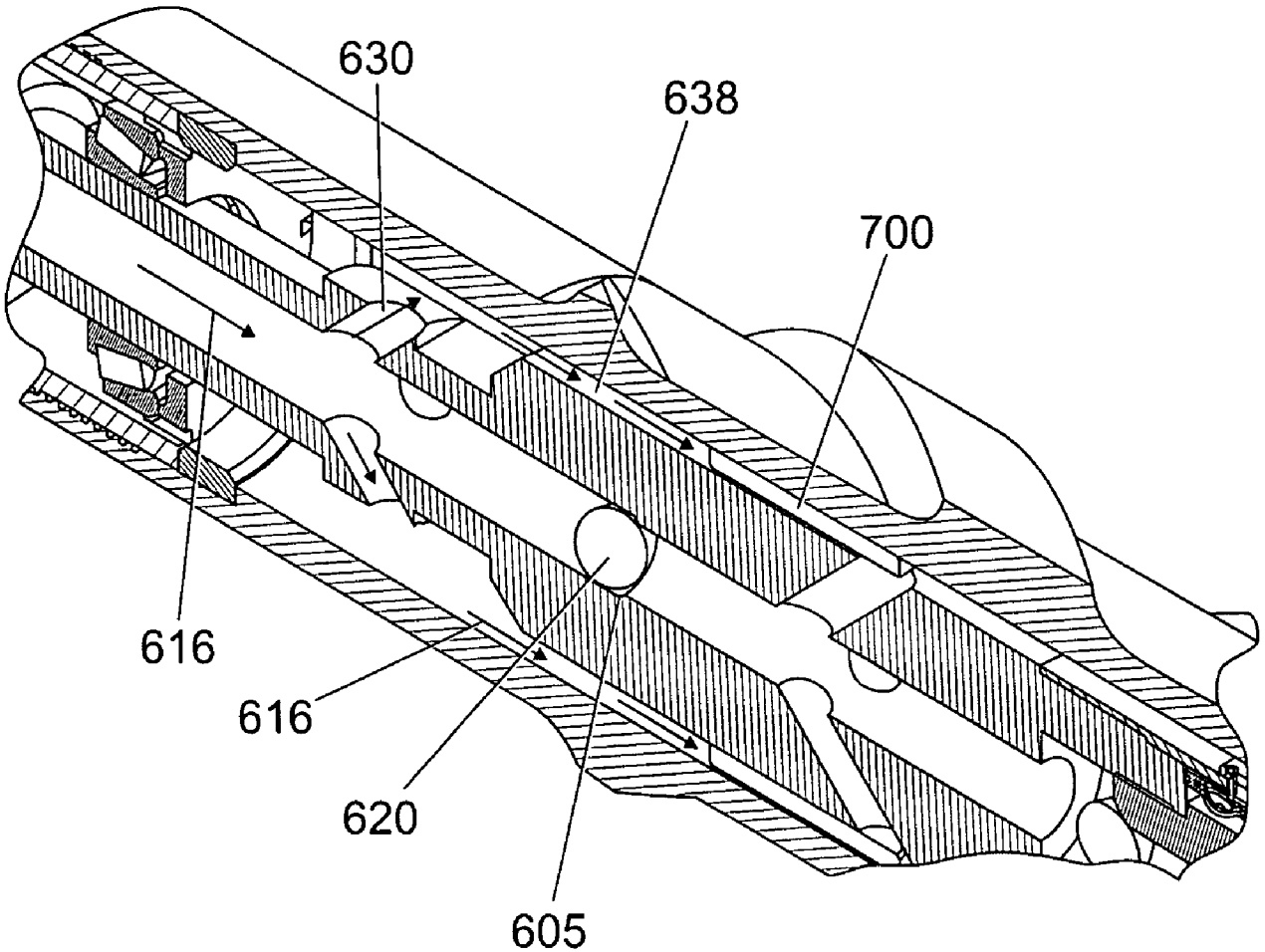
FIG. 17 is a perspective view of the core barrel assembly of FIG. 16 showing a diverted mud flow.

FIG. 16 shows an upper end of a core barrel assembly 10 having a conduit 600 therein. The conduit 600 has an upper passageway 630 and a lower passageway 610. The passageways 630, 610 direct fluids into an annulus 638 created between the inner assembly 14 and the outer assembly 18 of the core barrel assembly 10. An activation ring 700 is provided in the annulus 638, located between the upper and lower passageways 630, 610. The conduit 600 also has a portion of reduced inner diameter relative to the inner diameter of the remainder of the conduit to form a ball seat 605 located in a portion of the conduit 600 between the upper and the lower passageway 630, 610.

Before use, each module 432 is assembled. The lower ring 444 is glued to the outer liner 36. The inner liner 34 can then be correctly positioned relative to the outer liner 36 and spaced therefrom by the lower ring 444. The upper ring 443 is then glued to the upper end of the outer liner 36 to create half a liner module 432 as shown in FIG. 15. A corresponding half of liner module 432 is similarly provided to create a full liner module 432. A series of modules 432 are screwed to one another by means of the threads 410, 411 provided at the ends of each liner module 432 and inserted into the outer assembly 18 to form the core barrel assembly 10. The core barrel assembly 10 is lowered on a drill string to a subterranean formation from which the core sample 12 is to be obtained. As described for the previous embodiment, the air pockets 494 within the seals 441, 442 collapse as the pressure differential increases and the assembly 10 is run towards the formation of interest. Drilling mud is circulated through the core barrel assembly 10 to lubricate the drill bit 22. During operation of the drill bit 22 the mud flows through the conduit 600 and the lower passageway 610 in a direction indicated by arrows 615.

Once the core sample 12 has been recovered in the core barrel assembly 10, a ball 620 is dropped through the conduit 600. The ball 620 has a diameter greater than the inner diameter of the conduit 600 in the region of the ball seat 605. As a result, the ball 620 provides an obstruction to the mud flow in the conduit 600 and therefore the mud flow is forced through the upper passageway 630 in the direction shown by arrows 616 (shown in FIG. 17). However, the annulus 638 is blocked by the activation ring 700. As a result, the pressure increases behind the activation ring 700 until a point is reached when the pressure build-up forces the activation ring 700 to move through the annulus 638.

Figure 18:
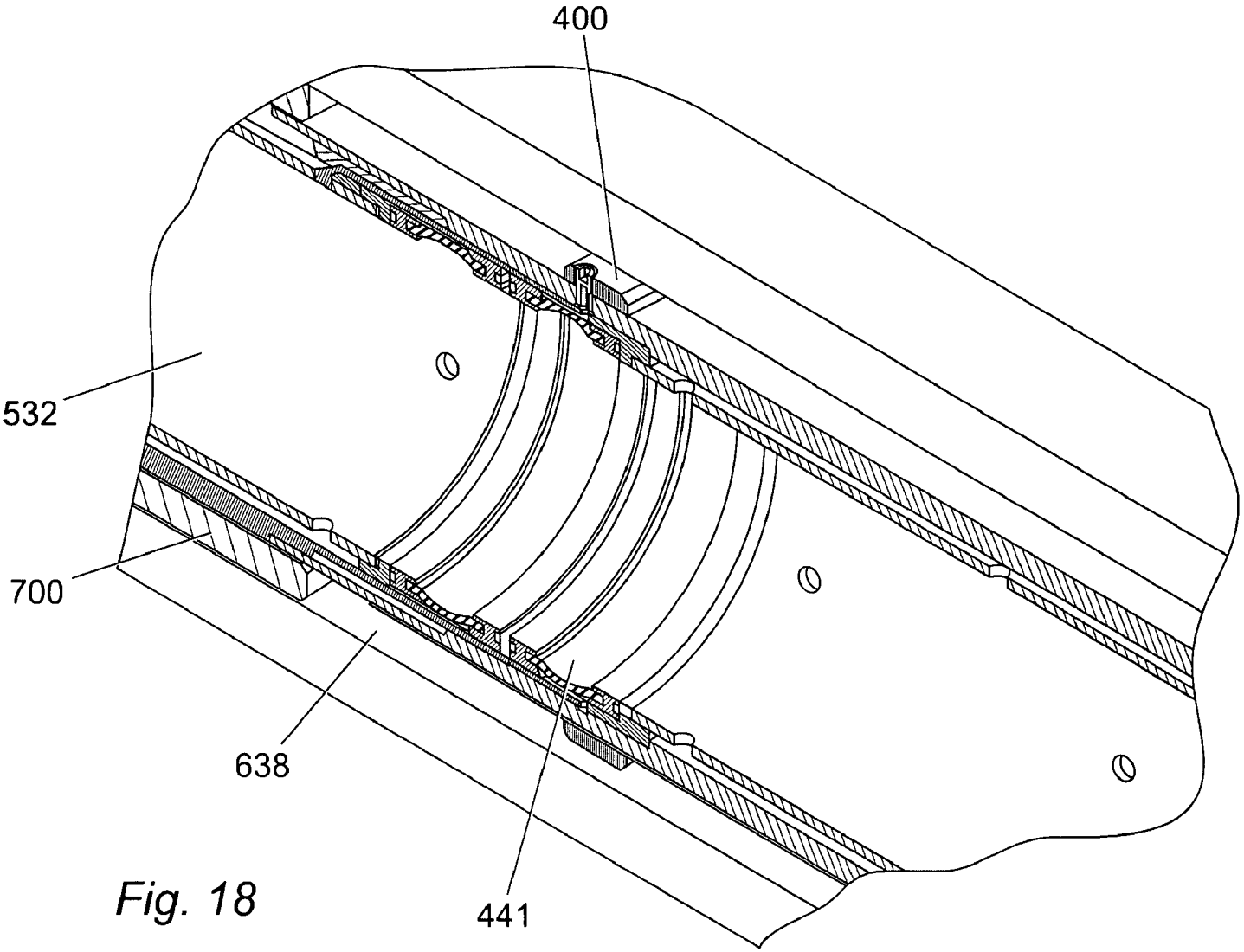
FIG. 18 is a perspective view of one half of the liner module of FIG. 15 located within the core barrel assembly.
Figure 19:
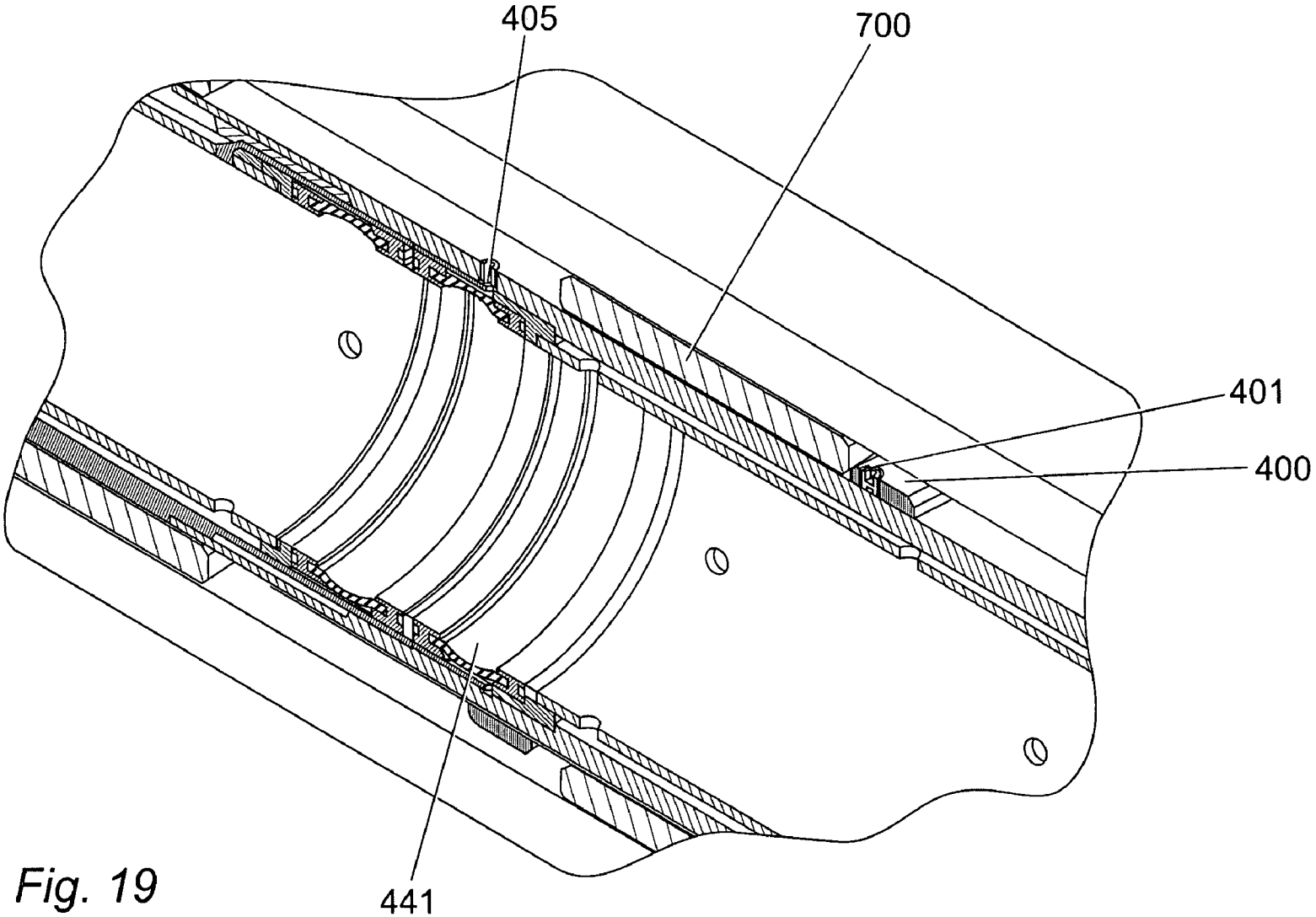
FIG. 19 is a perspective view of the liner module within the core barrel assembly of FIG. 18 showing a sheared outer band.
Figure 20:
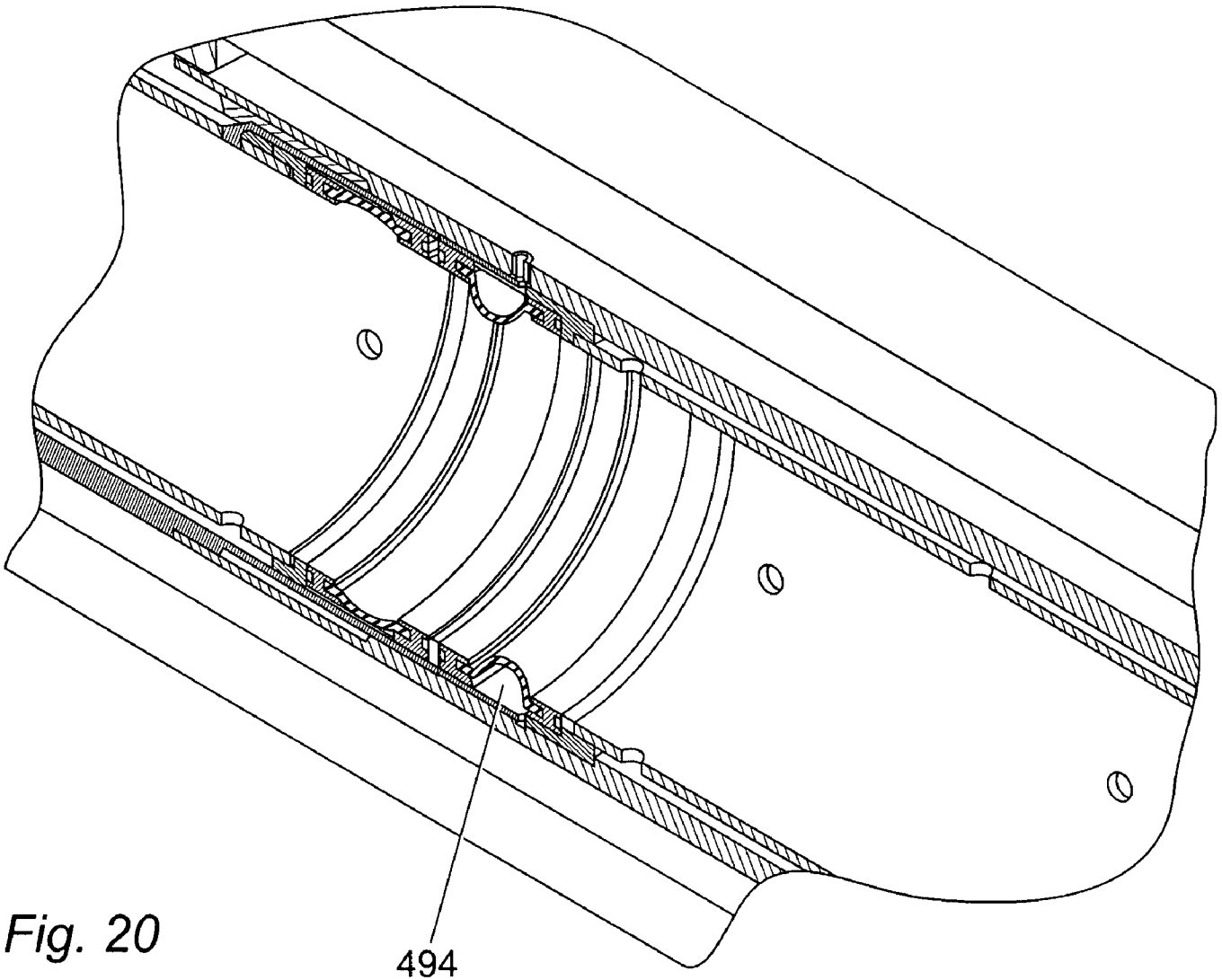
FIG. 20 is a perspective view of the liner module and core barrel assembly of FIG. 19, showing the seals in their original configuration.

FIG. 18 shows the activation ring 700 advancing through the annulus 638 towards the outer band 400. Continued pressure applied by the mud flow behind the activation ring 700, causes the activation ring 700 to contact the outer band 400. At a predetermined force the hollow shear screw 401 shears as the outer band 400 is pushed through the annulus 638 by the activation ring 700 as shown in FIG. 19. The fact that the shear screw 401 is hollow means that once the shear screw 401 has sheared, the interior of the seal 441 is in fluid communication with the annulus 638 via the aperture 405. The pressure of the seal will then equalise with the ambient pressure of the subterranean formation and the resilience of the seal 441 causes it to return to its original shape in the absence of a pressure differential across the pocket 494. The mud flow can drive the activation ring 700 throughout the annulus 638 to cause the pockets 494 of all the upper seals 441 to return to their original shape biased against the core sample 12.

However, the lower seals 442 are not in selective fluid communication with the ambient pressure and therefore the lower seals remain collapsed downhole. The lower seals 442 return to their original shape under their own resilience as the assembly 10 is recovered to surface and the pressure differential across the air pockets reduces. The sample 12 can then be recovered to surface and fluids obtained and collected from the sample 12 as previously described.

The above embodiment describes activation of the upper seal 441 in the subterranean formation. Since oil is generally immiscible with other downhole fluids and has a lower density relative to water and muds, the oil will float on the collected fluids. Thus, the above method and apparatus is useful for obtaining a sample where oil is the sampling fluid of interest, since the upper seal 441 of each module 432 is activated to seal off an upper end of the liner module 432. However, if the water content of the sample is required to be analysed, the lower seal 442 can be provided with an aperture 405 plugged with a hollow shear screw 401 held in an outer band 400. This arrangement allows activation of the lower seals 442 to seal each liner module 432 at the lower end. Alternatively, both seals 441, 442 can be provided with apertures 405, thereby enabling both upper seals 441 and lower seals 442 to be activated downhole.

Modifications and improvements can be made without departing from the scope of the invention.

The invention claimed is:

1. Apparatus for recovering a sample from a subterranean formation comprising a receptacle for receiving a sample and at least two pairs of seal assemblies disposed on an inner surface of the receptacle and arranged to seal against an outer surface of the sample when received in the receptacle in use, such that fluids present in a portion of the sample between adjacent seal assemblies are retained between the adjacent seal assemblies during recovery of the sample, wherein each seal assembly comprises at least one seal and wherein each seal is provided with at least one fluid pocket configured to change the shape of the seal as the volume of fluid within the fluid pocket alters in response to a change in pressure, so that in use, the seals are configured to extend radially inwardly from the inner surface of the receptacle, when the sample is disposed therein, to seal off an annulus between the sample and the inner surface of the receptacle.

2. Apparatus as claimed in claim 1, wherein the at least two seal assemblies are arranged to allow passage of a portion of the sample therethrough and to isolate portions of the receptacle, such that in use, each seal assembly creates a fluid-tight seal when the sample is disposed in the receptacle.

3. Apparatus as claimed in claim 1, wherein the apparatus further comprises at least one fluid chamber provided between adjacent seal assemblies and arranged to receive and retain fluids expelled from the sample.

4. Apparatus as claimed in claim 1 wherein the receptacle comprises an inner barrel wherein the seal assemblies are provided on an inner surface thereof, and an outer barrel spaced around and coaxial with the inner barrel.

5. Apparatus as claimed in claim 1, wherein the receptacle is provided in at least two separable portions.

6. Apparatus as claimed in claim 1, wherein a plurality of pairs of seal assemblies are spaced along the length of the inner surface of the receptacle and wherein each pair of seal assemblies has a separate fluid chamber disposed therebetween.

7. Apparatus as claimed in claim 1, further comprising an activation means arranged to selectively alter the configuration of the seal.

8. Apparatus as claimed in claim 1, further comprising an activation means arranged to selective alter the pressure differential across the at least one fluid pocket.

9. Apparatus as claimed in claim 7, wherein the at least one fluid pocket is in selective communication with an ambient pressure to which the apparatus is exposed and the activation means is operable to selectively expose the at least one fluid pocket to the ambient pressure.

10. Apparatus for recovering a sample from a subterranean formation comprising a receptacle for receiving a sample and at least two pairs of seal assemblies disposed on an inner surface of the receptacle and arranged to seal against an outer surface of the sample when received in the receptacle in use, such that fluids present in a portion of the sample between adjacent seal assemblies are retained between the adjacent seal assemblies during recovery of the sample, wherein the receptacle comprises an inner barrel wherein the seal assemblies are provided on an inner surface thereof, and an outer barrel spaced around and coaxial with the inner barrel, and wherein an annular reservoir is provided between the inner barrel and the outer barrel in selective fluid communication with a throughbore of the inner barrel, and wherein the annular reservoir is sealed, in the region of each seal assembly.

11. Apparatus for recovering a sample from a subterranean formation comprising a receptacle for receiving a sample and at least two pairs of seal assemblies disposed on an inner surface of the receptacle and arranged to seal against an outer surface of the sample when received in the receptacle in use, such that fluids present in a portion of the sample between adjacent seal assemblies are retained between the adjacent seal assemblies during recovery of the sample, wherein each seal assembly comprises at least one seal and wherein each seal is provided with at least one fluid pocket configured to change the shape of the seal as the volume of fluid within the fluid pocket alters in response to a change in pressure, so that in use, the seals are configured to extend radially inwardly from the inner surface of the receptacle, when the sample is disposed therein, to seal off an annulus between the sample and the inner surface of the receptacle, and wherein each fluid pocket is filled with fluid at atmospheric pressure.

12. A core barrel assembly comprising an apparatus according for recovering a sample from a subterranean formation comprising a receptacle for receiving a sample and at least two pairs of seal assemblies disposed on an inner surface of the receptacle and arranged to seal against an outer surface of the sample when received in the receptacle in use, such that fluids present in a portion of the sample between adjacent seal assemblies are retained between the adjacent seal assemblies during recovery of the sample, wherein each seal assembly comprises at least one seal and wherein each seal is provided with at least one fluid pocket configured to change the shape of the seal as the volume of fluid within the fluid pocket alters in response to a change in pressure, so that in use, the seals are configured to extend radially inwardly from the inner surface of the receptacle, when the sample is disposed therein, to seal off an annulus between the sample and the inner surface of the receptacle.

13. A method for recovering a sample from a subterranean formation or the like, comprising the steps of:

(a) providing a receptacle having an inner surface and disposing at least two pairs of seal assemblies on the inner surface of the receptacle, each seal assembly having at least one fluid pocket configured to alter the configuration of the seal assembly in response to a change in pressure;

(b) running the receptacle into a subterranean formation;

(c) accommodating the sample in the receptacle such that at least a portion of the sample is disposed between the seal assemblies and exposing the seal assemblies to a change in pressure whereby the seal assemblies seal against an outer surface of the sample;

(d) recovering the receptacle with the sample disposed therein; and (e) retaining fluids expelled from the sample between adjacent assemblies.

14. A method as claimed in claim 13, including retaining fluids expelled from the sample between each pair of seal assemblies during recovery.

15. A method as claimed in claim 14, including isolating fluids expelled from adjacent areas of the sample by sealing the fluids in respective fluid chambers.

16. A method as claimed in claim 15, including selecting the axial spacing between each pair of seal assemblies and thereby adjusting the resolution of the composition of fluids recovered from the sample for a given length of sample.

17. A method as claimed in claim 13, including altering the pressure differential across each fluid pocket after step (c) using an activation means.

18. A method as claimed in claim 13, including separating the receptacle by radially removing at least a portion of the receptacle.

* * * * *

UNITED STATES PATENT AND TRADEMARK OFFICE

CERTIFICATE OF CORRECTION

PATENT NO. : 7,600,580 B2
APPLICATION NO. : 11/409129
DATED : October 13, 2009
INVENTOR(S) : Cravatte et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 232 days.

Signed and Sealed this

Fifth Day of October, 2010

David J. Kappos

David J. Kappos
*Director of the United States Patent and Trademark Office*